US006296059B1

(12) United States Patent
Leeb et al.

(10) Patent No.: US 6,296,059 B1
(45) Date of Patent: Oct. 2, 2001

(54) REVERSE CIRCULATING CONTROL VALVE

(76) Inventors: Rodney Leeb, #194, 3803 Calgary Trail S., Suite 1556, Edmonton, Alberta (CA), T6J 5M8; Gerald Leeb, Box 89, Strome, Alberta (CA), T0B 2H0

( * ) Notice: Subject to any disclaimer, the term of this patent is extended or adjusted under 35 U.S.C. 154(b) by 0 days.

(21) Appl. No.: 09/518,671

(22) Filed: Mar. 3, 2000

(30) Foreign Application Priority Data

Mar. 23, 1999 (CA) ..... 2266809

(51) Int. Cl.[7] ..... E21B 34/10

(52) U.S. Cl. ..... 166/317; 166/318; 166/320; 166/332.4; 137/599.01; 137/601.01

(58) Field of Search ..... 166/318, 317, 166/320, 332.4; 137/601.2, 601.01, 599.01, 599.18, 599.09, 601.15

(56) References Cited

U.S. PATENT DOCUMENTS 531,304 * 12/1894 Dousman ..... 137/268
2,737,199 * 3/1956 Ingram ..... 137/268
3,289,694 * 12/1966 Frye ..... 137/533.13
4,064,937 12/1977 Barrington ..... 166/162
4,270,610 6/1981 Barrington ..... 166/317
4,324,293 4/1982 Hushbeck ..... 166/317
4,445,571 5/1984 Hushbeck ..... 166/317
4,749,037 * 6/1988 Christensen ..... 166/184
5,062,481 * 11/1991 Gullett ..... 166/153
5,673,751 * 10/1997 Head et al. ..... 166/155
5,819,852 * 10/1998 Cunningham et al. ..... 166/345

* cited by examiner

*Primary Examiner*—Hoang Dang
(74) *Attorney, Agent, or Firm*—Anthony R. Lambert

(57) ABSTRACT

A circulation control valve includes a top sub having a bore, a body connected to the top sub and having a first fluid passageway and a second fluid passageway parallel to the first fluid passageway, the bore communicating with both the first fluid passageway and second fluid passageway, a one-way valve in the second fluid passageway, and a first activatable block for the first fluid passageway. Upon upon activation of the block, fluid in the first fluid passageway is blocked and only flows through the second fluid passageway.

11 Claims, 9 Drawing Sheets

REVERSE CIRCULATING CONTROL VALVE

FIELD OF THE INVENTION

This invention relates to valves used in downhole operations.

BACKGROUND OF THE INVENTION

During downhole operations, in which tubing is concentrically located within casing or the borehole, there are two flow directions. In one flow direction, referred to as normal circulation, fluid flows down the tubing and up the annulus between the tubing and casing. In the other flow direction, referred to as reverse circulation, fluid flows down the annulus between the tubing and casing and up the tubing.

Sometimes during downhole operations, as for example during fraccing, it is necessary to allow both normal and reverse circulation, but when hydrocarbons, foreign fluid or gases are present downhole, it is preferable only to permit normal circulation.

In the present state of the art this is accomplished by pulling the downhole tools used for two way circulation out of the well and reentering the well with one way circulating tools.

SUMMARY OF THE INVENTION

In the present invention, it is proposed to provide a circulation control valve that allows two way circulation and may be configured, without removal from the well, into one way circulation. Two way circulation is used during downwell operations such as fraccing, stimulating and cleaning. When production fluid is present, the circulation control valve is set to one way circulation, preventing return fluid flow up the tubing and forcing the production fluids up the annulus in a controlled manner.

According to an aspect of the invention, there is provided a circulation control valve, comprising a top sub having a bore, a body connected to the top sub and having a first fluid passageway and a second fluid passageway parallel to the first fluid passageway, the bore communicating with both the first fluid passageway and second fluid passageway, a one-way valve in the second fluid passageway, and a first activatable block for the first fluid passageway, whereby upon activation of the block, fluid in the first fluid passageway is blocked and only flows through the second fluid passageway.

In a further aspect of the invention, there is provided a second activatable block for the second fluid passageway, the second activatable block being inactive when the first activatable block is active and blocking the first fluid passageway, and the second activatable block being active to block the second fluid passageway when the first activatable block is inactive.

In a further aspect of the invention, both the first activatable block and the second activatable block are formed from a sleeve disposed in the first fluid passageway; and the sleeve is slidable from a first position in which a lower portion of the sleeve blocks the first fluid passageway to a second position in which an upper portion of the sleeve blocks the second fluid passageway.

In a further aspect of the invention, the first fluid passageway and second fluid passageway lie side by side in the body; and a deflection shoulder is supported above the second fluid passageway to deflect fluid towards the first fluid passageway.

In a further aspect of the invention, the second fluid passageway is concentrically disposed within the first fluid passageway.

In a further aspect of the invention, the first fluid passageway and the second fluid passageway merge in a common bore above the one-way valve; and a sliding sleeve in the common bore is movable from a first position in which fluid may flow in both the first fluid passageway and the second fluid passageway to a second position in which the first fluid passageway is blocked.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
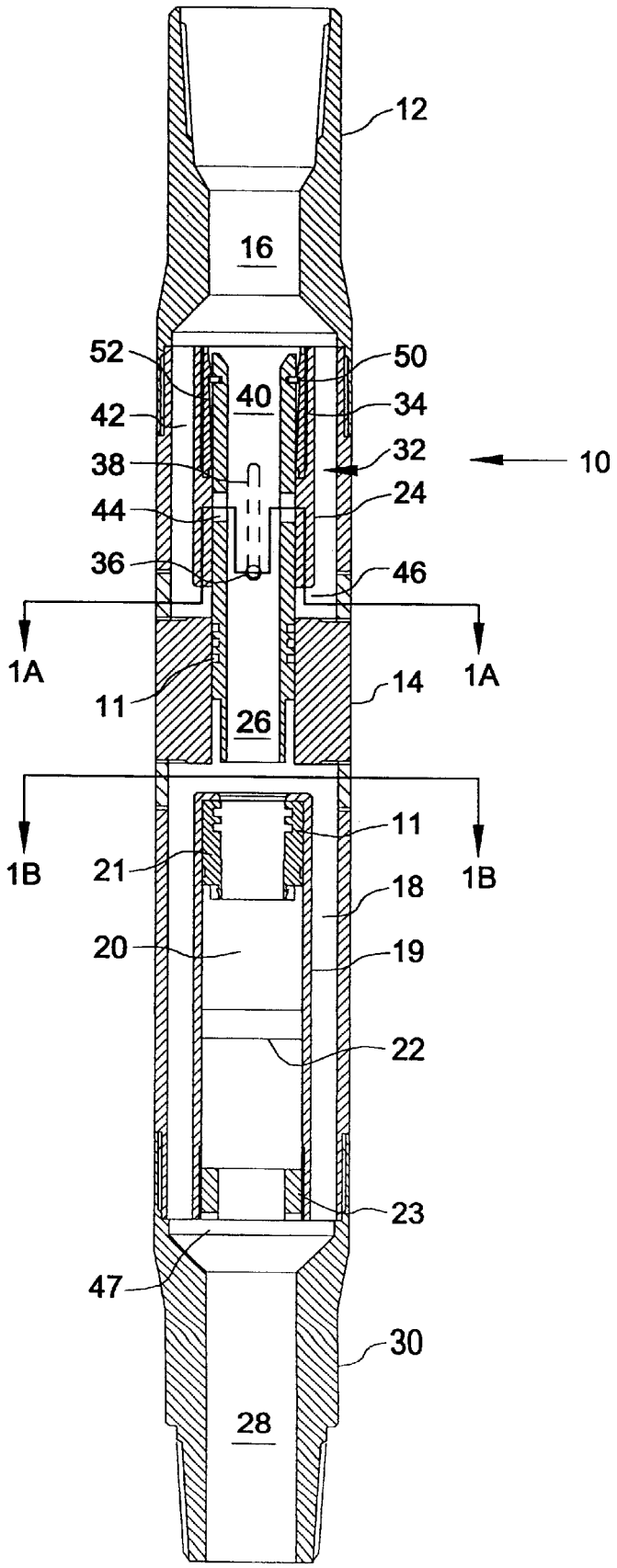
FIG. 1 is a lengthwise section through a first embodiment of the invention.
Figure 1A:
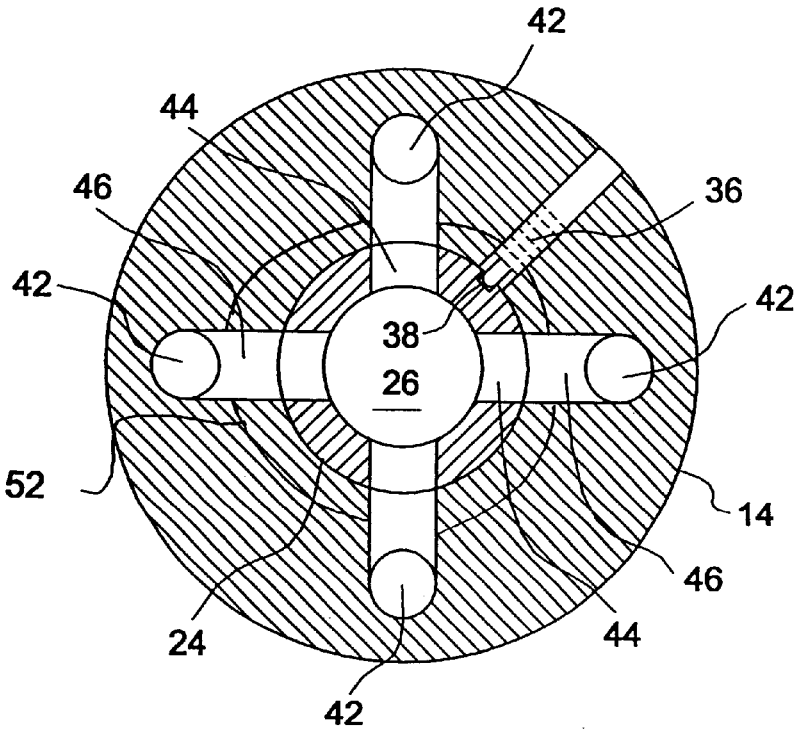
FIG. 1A is a cross-section through FIG. 1 along the line 1A—1A.

In this patent document, the word "comprising" is used in its non-limiting sense to mean that items following the word in the sentence are included and that items not specifically mentioned are not excluded. The use of the indefinite article "a" in the claims before an element means that one or more of the elements are specified, unless the context clearly requires that there be one and only one. A connection, unless the context otherwise dictates, is a conventional oilfield connection and when referring to two tubulars axially aligned and joined together will typically mean a conventional threaded connection. Various seals 11 shown in the drawings in conventional manner are not described in detail since their construction and use is well known.

Figure 1B:
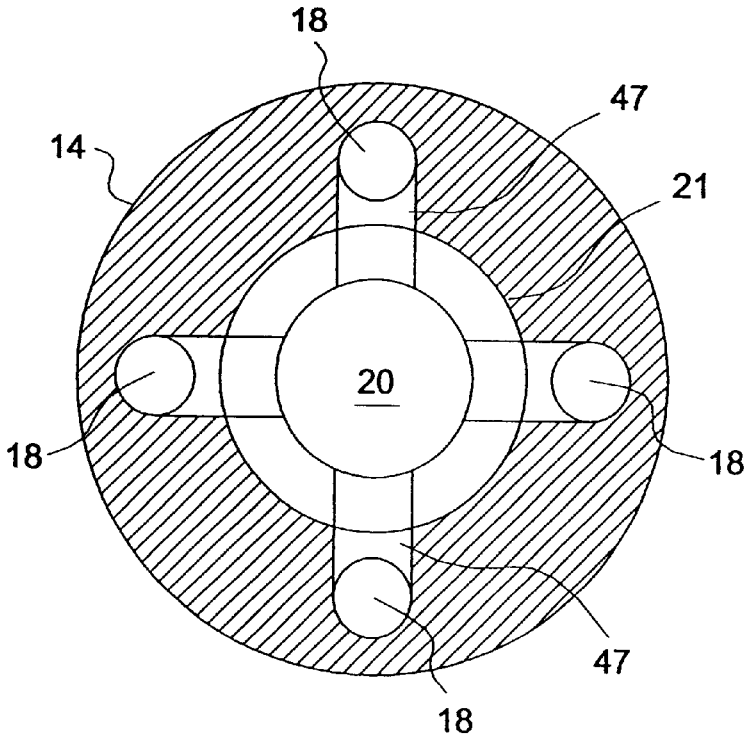
FIG. 1B is a cross-section through FIG. 1 along the line 1B—1B.
Figure 2:
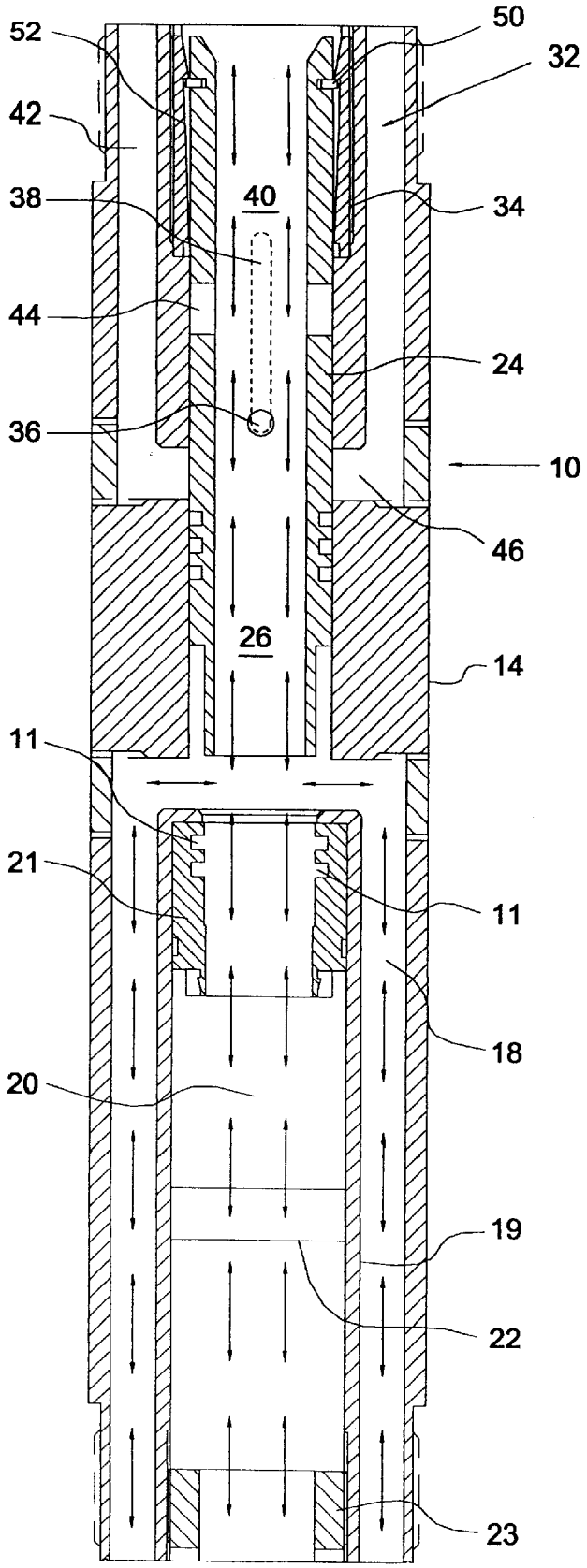
FIG. 2 is a lengthwise section through a first embodiment of the invention showing two way fluid flow.

Referring to FIG. 1, there is shown a circulation control valve 10 according to the invention. The circulation control valve 10 has a top sub 12 which may be connected into a conventional tubing string, whether threaded or continuous tubing (not shown). The top sub 12 connects to a body 14. A bore 16 in the top sub 12 communicates with a first fluid passageway 18 in the body 14 and also with a second fluid passageway 20 in the body 14. The fluid passageway 18 is formed of several conduits as shown in FIG. 1B. A one-way valve or valves 22, for example a float valve, sits in the second fluid passageway 20 and permits flow only in one direction through the second fluid passageway as indicated by the arrows in FIG. 2 and FIG. 3. The second fluid passageway 20 is defined by tubular 19, and the first fluid passageway 18 is formed by one or more passages between the tubular 19 and body 14. An end cap 23 threads into the bottom of the tubular 19 that holds the one way valve 22 in place and allows fluid to pass through.

Figure 3:
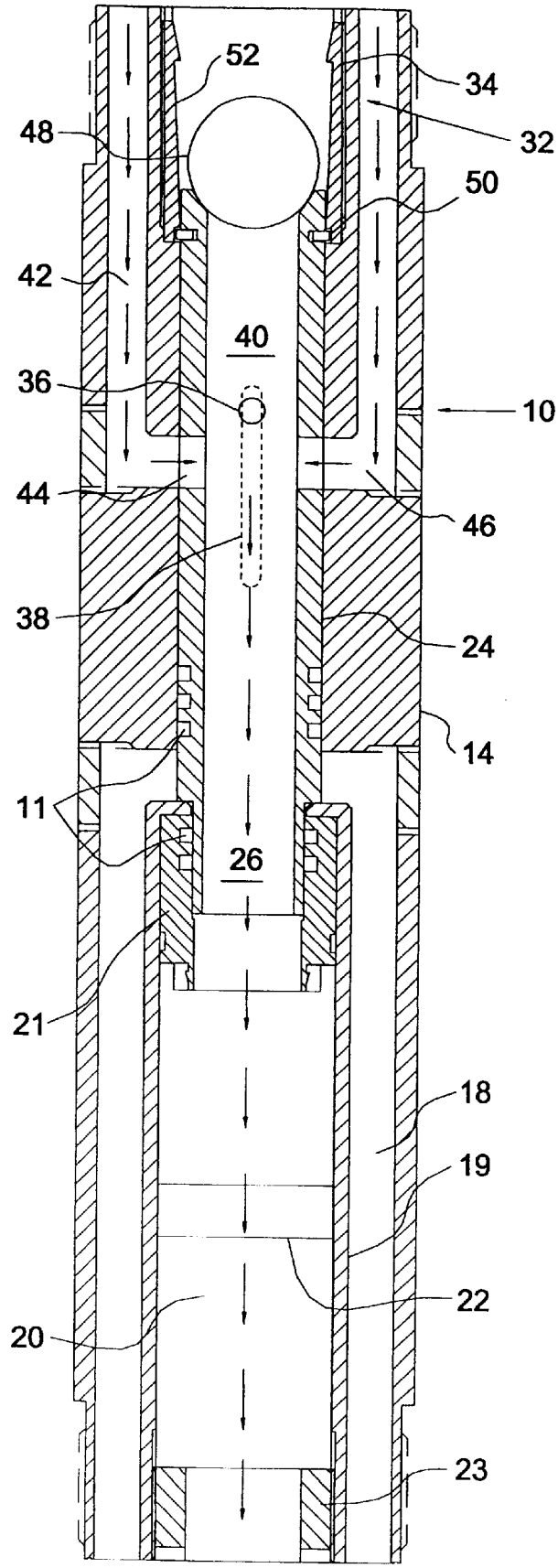
FIG. 3 is a lengthwise section through a first embodiment of the invention showing one way fluid flow.

A sliding sleeve 24 in an upper portion of the body 14 acts as an activatable block for the first fluid passageway 18. Upon activation of the sliding sleeve 24 as shown in FIG. 3, fluid in the first fluid passageway 18 is blocked and only flows through the second fluid passageway 20. In the example shown in FIG. 1, the second fluid passageway 20 is concentrically disposed within the first fluid passageway 18.

The first fluid passageway 18 and the second fluid passageway 20 merge in a common bore 26 above the one-way valve 22. The sliding sleeve 24 is housed in the common bore 26 and is movable from a first position in which fluid may flow in both the first fluid passageway and the second fluid passageway (FIG. 2) to a second position in which the first fluid passageway is blocked (FIG. 3). Below the one-way valve 22, the first fluid passageway 18 and the second fluid passageway 20 merge in a bore 28 through side ports 47 in a bottom sub 30 connected to a lower end of the body 14.

Control of the sliding sleeve 24 is accomplished using a sliding sleeve control mechanism 32 disposed in a chamber formed in an upper portion of the body 14. The sliding sleeve control mechanism 32 includes a piston stop 34, set screw 36 and groove 38. The screw 36 has a hardened rounded end that tightens against the groove 38. The screw 36 acts as both to align the sleeve 24 and to provide pressure resistance against movement of the sleeve 24. The piston stop 34 is tubular and defines a bore 40 and side passages 42. The sliding sleeve 24 has circumferentially spaced ports 44 which may be aligned with a lower portion 46 of the side passages 42 using the screw 36 in groove 38. In the two way fluid flow condition, the sliding sleeve 24 blocks the lower portion 46 of the side passages 42, and fluid is compelled to flow through the sliding sleeve 24 and from there into both the first fluid passageway 18 and the second fluid passageway 20. During reverse circulation, as shown by the double ended arrows in FIG. 2, fluid may flow up through the first fluid passageway 18 into the bore of the sliding sleeve 24 and thence up into the top sub 12 and the rest of the tubing string. The piston stop 34 holds the sleeve 24 in the upper position by a latch formed by frictional contact of ring collet 50 in tapered sleeve 52 against tapered sleeve 52 and the set screw 36 in tapered groove 38.

When only one way fluid flow is required, the sliding sleeve 24 is activated and slid into the position shown in FIG. 3, with the bottom end of the sliding sleeve 124 received by seal assembly 21 at the top of the tubular 19. The seal assembly 21 has several seals 11 that seal against the bottom of the sleeve 24 when it slides into the seal assembly 21. The ports 44 are aligned with the lower portion 46 of the passages 42 and fluid flows through the side passages 42 into the bore 26. Movement of the sliding sleeve 24 blocks the first fluid passageway 18 and forces fluid in the bore 26 to flow unidirectionally through the one way valve 22 and from there into the bottom sub 30. Various mechanisms may be used to activate the sliding sleeve 24. In one example, a sleeve activator such as a ball 48 may be dropped onto the top of the sleeve 24 and the weight of the ball 48 plus fluid pressure then activates the sliding sleeve 24. The sleeve 24 has a tapered mouth to receive the ball 48, or fluid pressure used to activate the sleeve 24, and an outside lip to prevent fluid entering the seals. The ball 48 is directed to its seating position on the top of sleeve 24 by a downward slanting shoulder 13 in top sub 12. Downward motion of the sliding sleeve 24 is stopped by set screw 36 which is screwed into the piston stop 34. The screw 36 slides in groove 38 in sleeve 24, but the sliding sleeve 24 stops downward movement when the sleeve 24 has slid so far that the screw 36 is at the end of the groove 38. In addition, a ring collet 50 in a ring groove in an upper portion of the sleeve 24 slides in a tapered sleeve 52 in the piston stop 34. The tapered sleeve 52 narrows downward so compressive forces on the ring collet 50 due to the narrowing of the sleeve 52 retard the downward movement of the sleeve 24. To return to the two way fluid flow condition, the ball 48 must be removed by fishing or internal devices such as a spring.

Figure 4:
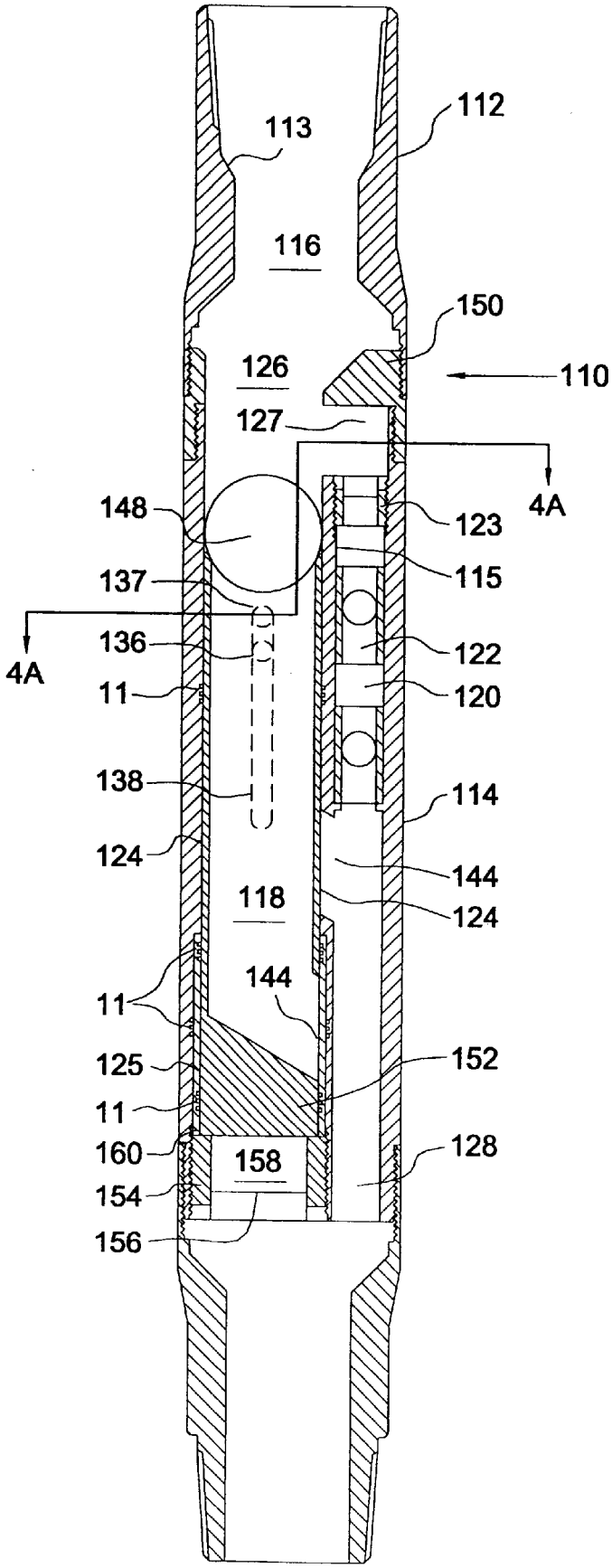
FIG. 4 is a lengthwise section through a second embodiment of the invention.
Figure 4A:
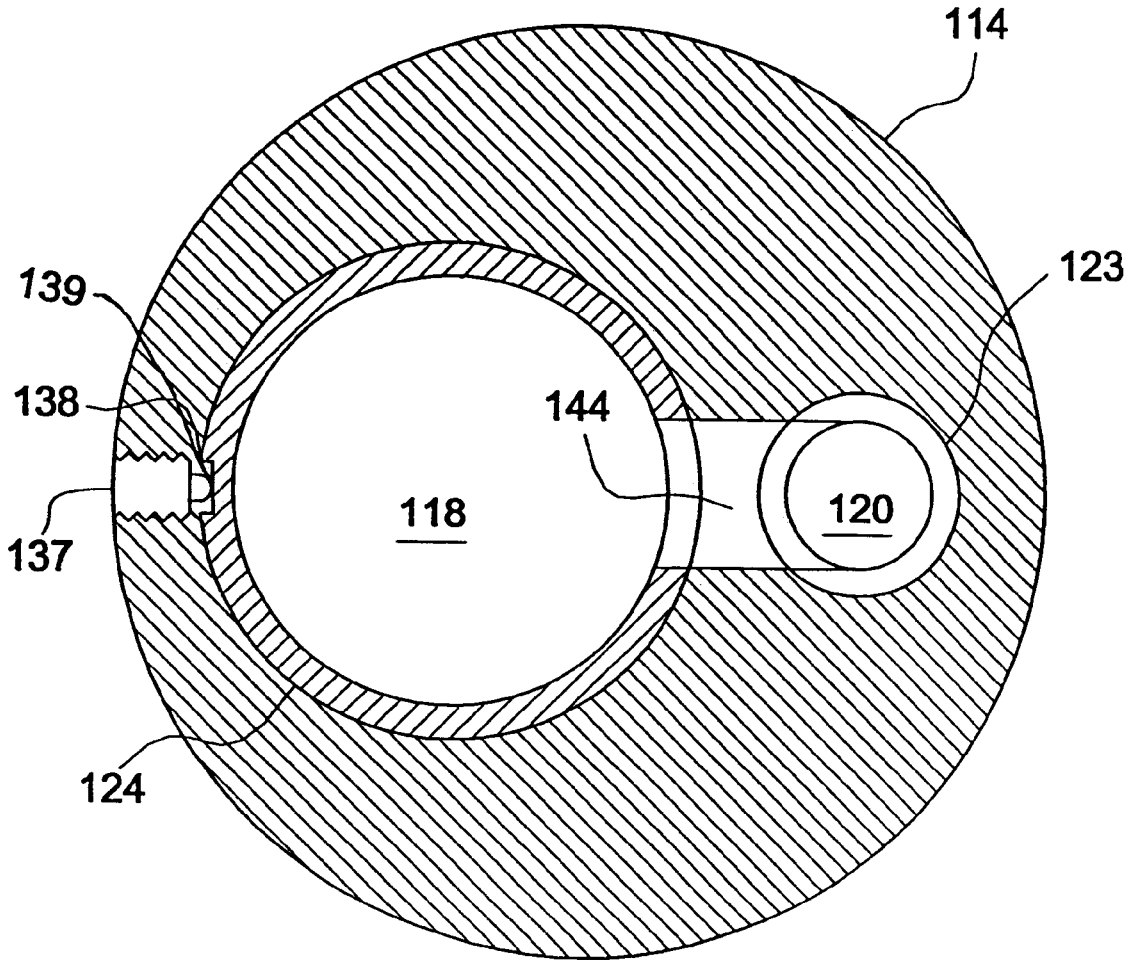
FIG. 4A is a cross-section through FIG. 4 along the line 4A—4A.

Referring in particular to FIG. 4, a second embodiment of a circulation control valve 110 is shown. In this embodiment, there is a second activatable block for a second fluid passageway 120, the second activatable block being inactive when a first activatable block is active and blocking a first fluid passageway 118, and the second activatable block being active to block the second fluid passageway 120 when the first activatable block is inactive.

In FIG. 4, the circulation control valve 110 has a top sub 112 which may be connected into a conventional tubing string, whether conventional or continuous tubing (not shown). The top sub 112 connects to a body 114. A bore 116 in the top sub 112 communicates with a first fluid passageway 118 in the body 114 and also with a second fluid passageway 120 in the body 114. The first fluid passageway 118 and the second fluid passageway 120 lie side by side in the body 114. A one-way valve or valves 122, for example a float valve, sits in the second fluid passageway 120 and permits flow only in one direction through the second fluid passageway 120 as indicated by the arrows in FIG. 5. A top float assembly cap 123 threads into the channel defined by internal wall 115 and body 114 to secure the one way valve 122 in the second fluid passageway 120.

Figure 5:
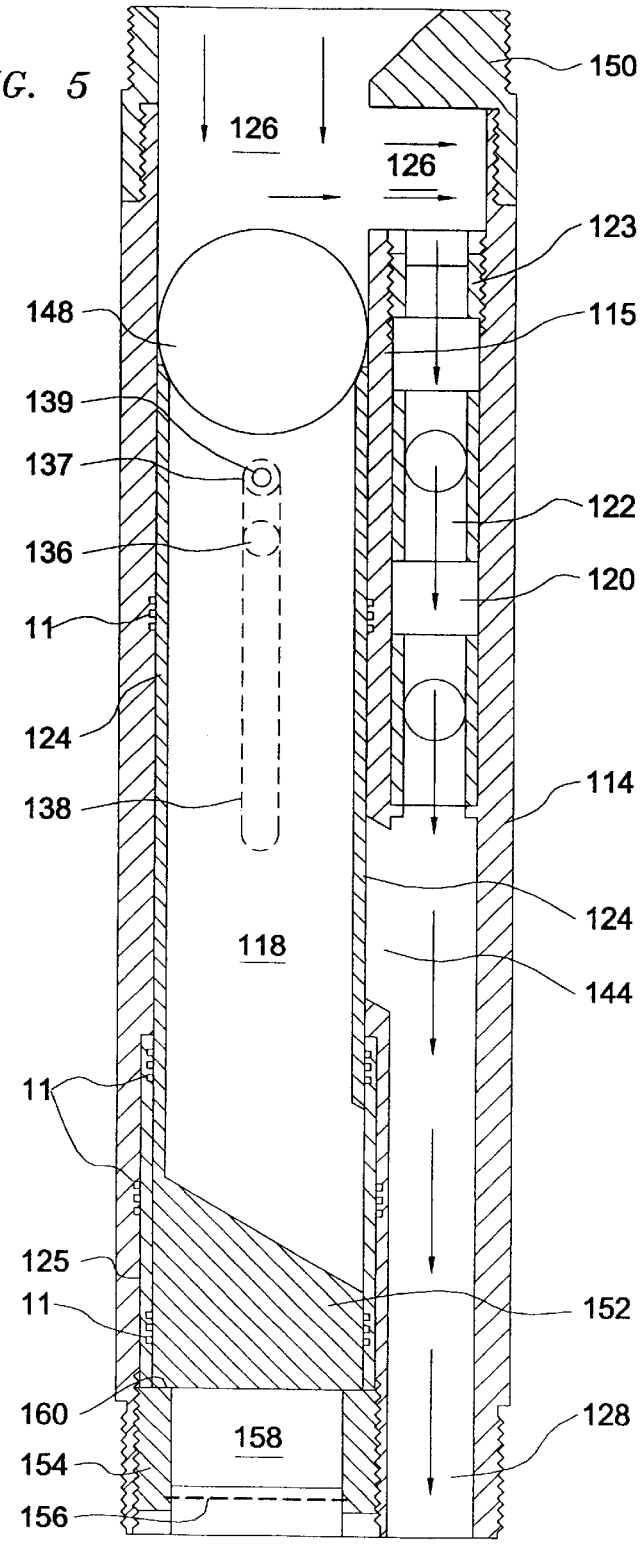
FIG. 5 is a lengthwise section through a second embodiment of the invention showing one way fluid flow.

A sliding sleeve 124 in a middle portion of the body 114 acts as an activatable block for both the first fluid passageway 118 and the second fluid passageway 120. Upon activation of the sliding sleeve 124 as shown in FIG. 5, fluid in the first fluid passageway 118 is blocked and only flows through the second fluid passageway 120. The sliding sleeve 124 has a tapered moth to accomodate a piston activator or activation fluid, with an outside lip to prevent frac fluid or other fluid from entering the seals 11. The sleeve 124 is solid on the bottom, and hollow from the angled opening 144 to the top.

Figure 7:
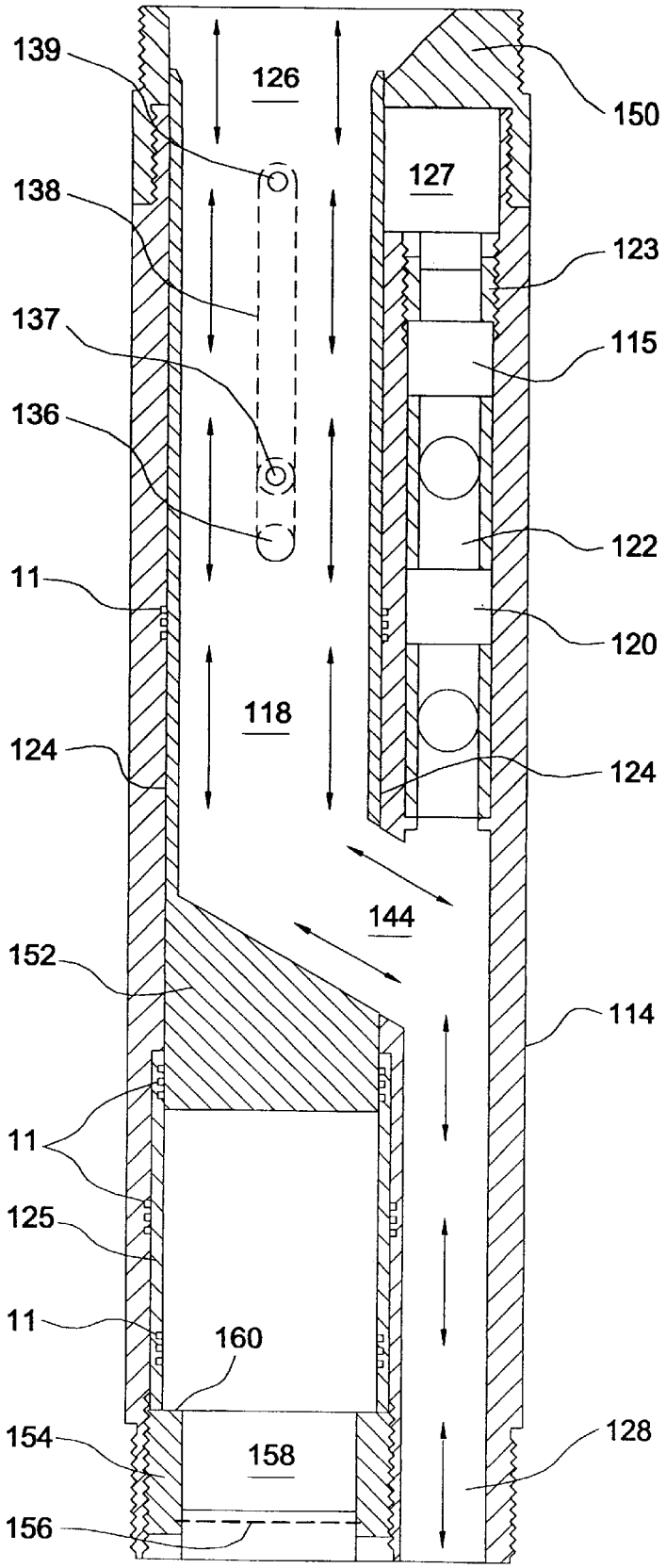
FIG. 7 is a lengthwise section through a second embodiment of the invention showing two way fluid flow.

The first fluid passageway 118 and the second fluid passageway 120 merge in a common bore 126 above the one-way valve 122. The sliding sleeve 124 is housed in first fluid passageway 118 and is movable from a first position in which fluid flows only in the first fluid passageway 118 (FIG. 7) to a second position in which the first fluid passageway is blocked (FIGS. 4 and 5). Below the one-way valve 122, the first fluid passageway 118 and the second fluid passageway 120 merge in a bore 128 in a bottom sub 130 connected to a lower end of the body 114.

Figure 6:
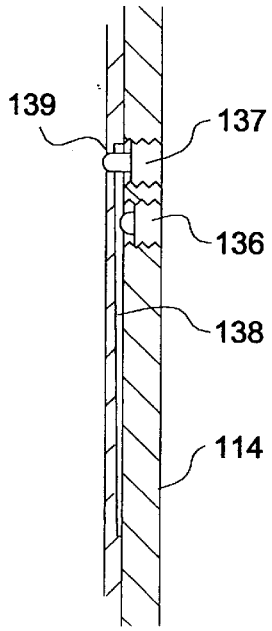
FIG. 6 is a lengthwise section showing a mechanism for setting a sliding sleeve in the operation of the second embodiment.

Control of the sliding sleeve 124 is accomplished using a sliding sleeve control mechanism 132 shown particularly in FIG. 6 and disposed in the first fluid passageway 118. The sliding sleeve control mechanism 132 includes a set screw 136, spring pin 137 and groove 138. The set screw 136 and pin 137 thread into the body 114, with the spring pin 137 above the set screw, while the groove 138 is machined in the sleeve 124. The groove 138 is tapered and has at one end an opening 139 to receive the spring pin 137. The sliding sleeve 124 has a port 144 which may be aligned with an opening into the common bore 128.

In the two way fluid flow condition, the sliding sleeve 124 blocks the entry 127 into the second fluid passageway 120, and fluid is compelled to flow through the sliding sleeve 124 and from there into bore 128. During reverse circulation, as shown by the double ended arrows in FIG. 7, fluid may flow up through borew 128 into the first fluid passageway 118 and then into the bore 116 in the top sub 112 and the rest of the tubing string.

When only one way fluid flow is required, the sliding sleeve 124 is activated and slid into the position shown in FIGS. 4 and 5. The sleeve 124 slides past entry 127 into the second fluid passageway 120, and permits fluid to flow into the second fluid passageway 120. At the same time, port 144 moves past the entry into the bore 128, and fluid is prevented from flowing through the first fluid passageway 118. Movement of the sliding sleeve 124 thus blocks the first fluid passageway 118 and forces fluid in the bore 126 to flow unidirectionally through the one way valve 122 and from there into the bottom sub 130. Various mechanisms may be used to activate the sliding sleeve 124. In one example, a ball 148 may be dropped onto the top of the sleeve 124 and the weight of the ball 148 plus fluid pressure then activates the sliding sleeve 124. The ball 148 is directed to its seating position on the top of sleeve 124 by a downward slanting shoulder 113 in top sub 112. Downward motion of the sliding sleeve 124 is slowed by set screw 136 sliding in groove 138, and stopped when the spring pin 137 engages with opening 139 at the end of groove 138. The screw 136 slides in groove 138, but the sliding sleeve 124 stops downward movement when the sleeve 124 has slid so far that the pin 137 is at the end of the groove 138. To return to the two way fluid flow condition, the ball 148 must be removed by fishing.

Thus, the sleeve 124 forms both the first activatable block and the second activatable block, with the sleeve 124 being slidable from a first position in which a lower portion of the sleeve 124 blocks the first fluid passageway 118 to a second position in which an upper portion of the sleeve 124 blocks the second fluid passageway 120.

A deflection shoulder 150 formed as part of the top sub 112 is supported by the top sub 112 above the second fluid passageway 120 to deflect fluid towards the first fluid passageway 118. This is useful for fraccing, so that sand in the frac fluid will not erode through the top sub 112 into the second fluid passageway 120. A further deflection shoulder 152 is formed in the lower part of sleeve 124 to deflect fluid away from cap 154 into the bore 128. The cap 154 has four grooves for a wrench so it may be threaded to the sleeve 124. A fine screen 156 is attached to an opening on the sleeve cap 154 to allow only fluids to enter the channel 158. Thus, when the sleeve 124 is in the upper position, no solids may enter into the first fluid passageway 118 where they may cause wear between the sleeve 124 and the body 114 and the fluid acts as a cushion when the sleeve 124 is activated. A shoulder 160 acts as a stopper when the sleeve 124 is in the closed position.

A bottom body cap (not shown) may also be supplied connected to the main body 114 by fasteners, that allow the cap to be pushed off by a present pressure. The cap prevents any foreign fluids entering the main body 114. The bottom cap can also thread to the main body with jets on the bottom or threads for other assemblies to be attached. The lower end of the sleeve 124 sits in a seal unit 125 that slides into the bottom of the first fluid passageway 118. The seal unit 125 has several inner and outer seals 11 that seal against the body 114 and the bottom of the sleeve 124. The body of the sleeve 124 slides into the bottom seal unit 125.

Figure 8:
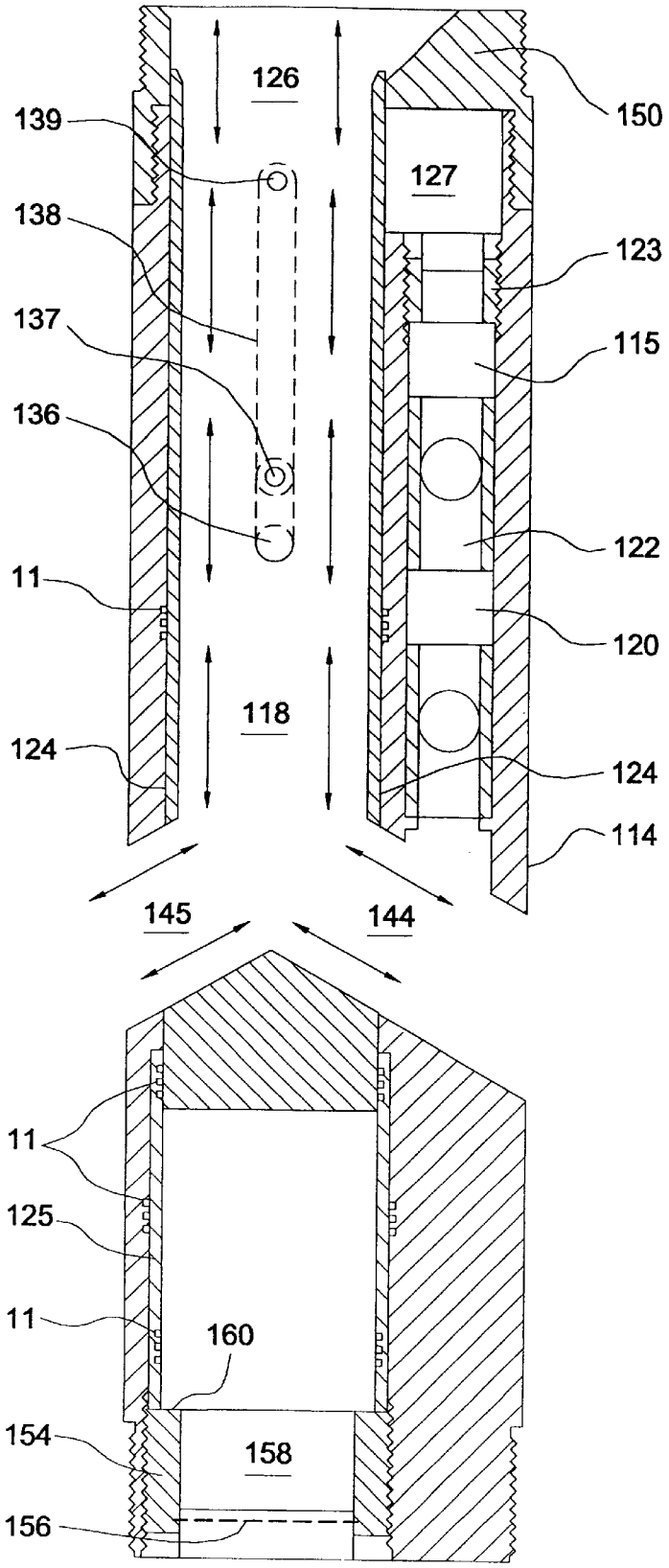
FIG. 8 is a lengthwise section through a modified second embodiment of the invention.

In a further embodiment shown in FIG. 8, the same design as FIG. 4 is shown, except that the first fluid passageway 118 bifurcates and fluid may flow through port 145 as well as through port 144 out of the sleeve 124.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A circulation control valve, comprising:

a top sub having a bore;

a tubular body connected to the top sub and containing a first fluid passageway and a second fluid passageway parallel to the first fluid passageway, the bore communicating with both the first fluid passageway and second fluid passageway;

a one-way valve in the second fluid passageway; and a first activatable block for the first fluid passageway, the first activatable block being contained entirely within the tubular body, whereby upon activation of the block, fluid in the first fluid passageway is blocked and only flows through the second fluid passageway.

2. The circulation control valve of claim 1 further comprising a second activatable block for the second fluid passageway, the second activatable block being inactive when the first activatable block is active and blocking the first fluid passageway, and the second activatable block being active to block the second fluid passageway when the first activatable block is inactive.

3. The circulation control valve of claim 2 in which:

both the first activatable block and the second activatable block are formed from a sleeve disposed in the first fluid passageway; and the sleeve being slidable from a first position in which a lower portion of the sleeve blocks the first fluid passageway to a second position in which an upper portion of the sleeve blocks the second fluid passageway.

4. The circulation control valve of claim 3 in which:

the first fluid passageway and second fluid passageway lie side by side in the body; and a deflection shoulder is supported above the second fluid passageway to deflect fluid towards the first fluid passageway.

5. The circulation control valve of claim 1 in which the second fluid passageway is concentrically disposed within the first fluid passageway.

6. The circulation control valve of claim 2 in which:

the first fluid passageway and the second fluid passageway merge in a common bore above the one-way valve; and a sliding sleeve in the common bore is movable from a first position in which fluid may flow in both the first fluid passageway and the second fluid passageway to a second position in which the first fluid passageway is blocked.

7. A circulation control valve, comprising:

a top sub having a bore;

a body connected to the top sub and having a first fluid passageway and a second fluid passageway parallel to the first fluid passageway, the bore communicating with both the first fluid passageway and second fluid passageway;

a one-way valve in the second fluid passageway;

a first activatable block for the first fluid passageway, whereby upon activation of the block, fluid in the first fluid passageway is blocked and only flows through the second fluid passageway; and a second activatable block for the second fluid passageway, the second activatable block being inactive when the first activatable block is active and blocking the first fluid passageway, and the second activatable block being active to block the second fluid passageway when the first activatable block is inactive.

8. The circulation control valve of claim 7 in which:

both the first activatable block and the second activatable block are formed from a sleeve disposed in the first fluid passageway; and the sleeve being slidable from a first position in which a lower portion of the sleeve blocks the first fluid passageway to a second position in which an upper portion of the sleeve blocks the second fluid passageway.

9. The circulation control valve of claim 8 in which;

the first fluid passageway and second fluid passageway lie side by side in the body; and a deflection shoulder is supported above the second fluid passageway to deflect fluid towards the first fluid passageway.

10. The circulation control valve of claim 7 in which:

the first fluid passageway and the second fluid passageway merge in a common bore above the one-way valve; and a sliding sleeve in the common bore is movable from a first position in which fluid may flow in both the first fluid passageway and the second fluid passageway to a second position in which the first fluid passageway is blocked.

11. A circulation control valve comprising:

a top sub having a bore;

a body connected to the top sub and having a first fluid passageway and a second fluid passageway parallel to the first fluid passageway, the bore communicating with both the first fluid passageway and second fluid passageway;

a one-way valve in the second fluid passageway;

a first activatable block for the first fluid passageway, whereby upon activation of the block, fluid in the first fluid passageway is blocked and only flows through the second fluid passageway; and the second fluid passageway being concentrically disposed within the first fluid passageway.

* * * * *